United States Patent [19]

Schellenberg

[11] Patent Number: 4,632,298

[45] Date of Patent: Dec. 30, 1986

[54] PACKING CONTAINER

[75] Inventor: Walter Schellenberg, Diepoldsau, Switzerland

[73] Assignee: Sandherr Packungen AG, Diepoldsau, Switzerland

[21] Appl. No.: 826,729

[22] Filed: Feb. 6, 1986

[30] Foreign Application Priority Data

Apr. 24, 1985 [CH] Switzerland ..... 01751/85

[51] Int. Cl.[4] ..... B65D 3/10; B65D 5/00; B65D 13/00

[52] U.S. Cl. ..... 229/5.5; 229/3.5 MF; 229/43; 220/270; 220/258

[58] Field of Search ..... 229/3.5 MF, 4.5, 5.5, 229/5.6, 43; 220/270, 258

[56] References Cited

U.S. PATENT DOCUMENTS

| | | | |
|---|---|---|---|
| 3,951,331 | 4/1976 | Smith et al. | 220/258 |
| 4,190,189 | 2/1980 | DeForest | 229/4.5 |
| 4,196,841 | 4/1980 | Smith et al. | 229/4.5 |
| 4,209,126 | 6/1980 | Elias | 229/3.5 MF |
| 4,268,336 | 5/1981 | Piltz et al. | 229/3.5 MF |
| 4,538,758 | 9/1985 | Griffith | 229/4.5 |

*Primary Examiner*—George T. Hall

[57] ABSTRACT

The packing container comprises a cylindrical cardboard body produced in a wrapping process and whose inside is lined with an aluminum foil and is provided with container bases fixed to its ends. The container bases comprise an aluminum foil with a cylindrical border and a cardboard plate or board fixed to the planar part of the container base. This cardboard plate protects the thin aluminum foil. A tear-open grip is provided on one of the container bases and is shaped through a u-shaped punching line from the cardboard plate and the aluminum foil fixed thereto. The opening formed by the punching line is closed by a foil portion, which is stuck to the bottom of the container base. On opening the packing container, the connection between the cylindrical border of the container base and the inner face of the container body is torn apart.

9 Claims, 4 Drawing Figures

PACKING CONTAINER

BACKGROUND OF THE INVENTION

The present invention relates to a packing container with a cylindrical container body comprising coated cardboard material and container bases fixed to its two end and in contact with the inner face of the container body by a cylindrical border region, at least one of the container bases comprising an aluminium foil and having a tear-open grip.

A container of this type is known from German Pat. No. 2 615 812. One of the two bases of this known container is made from sheet metal and is tightly clamped to the container body by beading. The other container base intended for opening of the container is made from a thin heat sealing aluminium foil, on which is provided a tear-open tab. By means of its cylindrical border produced by deep-drawing, the aluminium foil is bonded or sealed to the container body. As it can easily be destroyed by shock or impact action, e.g. during transportation, it requires an additional cover, which is connected to the container body.

SUMMARY OF THE INVENTION

The main object of the invention is to provide a packing container of the aforementioned type, which can be manufactured with relatively little expenditure and which requires no additional cover to protect a base of the container.

In order to implement this and still further objects of the invention, which will become more readily apparent as the description proceeds, the invention contemplates a packing container of the aforementioned type and comprising additional a cardboard plate fixed to the aluminium foil portion stretched over the open cross-section of the container body and thereby reinforcing said portion of a container base.

BRIEF DESCRIPTION OF THE DRAWINGS

The invention is described in greater detail hereinafter relative to non-limitative embodiments of the packing container and with reference to the attached drawings, wherein show.

DETAILED DESCRIPTION OF THE PREFERRED EMBODIMENTS

Figure 1:
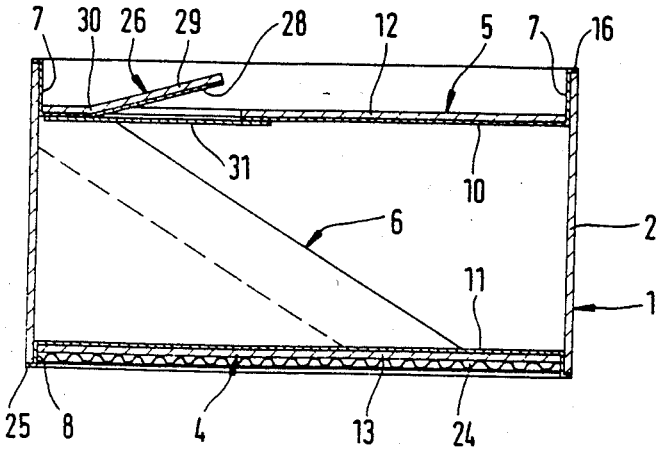
FIG. 1 a cross-section through a box according to a first embodiment of the invention, FIG. 2 a plan view on part of the box according to FIG. 1, FIG. 3 a cross-section through a box according to a second embodiment of the invention and FIG. 4 a cross-section through a box according to a third embodiment of the invention.

The container body 2 of the packing container according to the invention and constructed as a box 1 with a circular cylindrical shape is produced from cardboard by winding or wrapping in conventional manner and is coated on its inside with a thin aluminium foil. For forming a hot-seal connection with the two container bases 4,5, the aluminium foil has a heat sealing coating on the side facing the interior of the box. For producing a gas-tight box, the side of the aluminium foil sealing the container body remote from the box interior is coated with a plastic material, e.g. polyester and the connection along the overlap seam 6 takes place by means of a two-component adhesive, so that there is a normal overlap along the wrapping or overlap seam, instead of a fold along a wrapping border and a corresponding triple, bead forming coating thickness along the seam, as is the case in known containers of this type. The resulting reduced profiling along the overlap seams of the container body permits a gas-tight sealing or bonding of the cylindrical borders 7,8 of the two container bases to the container body 2.

The container bases 4,5 are formed by an aluminium foil 10,11 and a cardboard plate or board 12,13, the cardboard plate 12,13 has the function of protecting that part of the aluminium foil 12,13 stretched in membrane-like manner over the container cross-section particularly against forces acting from outside, so that it is connected e.g. by an adhesive to the outwardly turned side of the aluminium sheet. However, the cardboard plate 12,13 prevents an outward curving of the aluminium foil 10,11, if there is an internal overpressure in the box, e.g. through packing an aerated or carbonated beverage.

Figure 2:
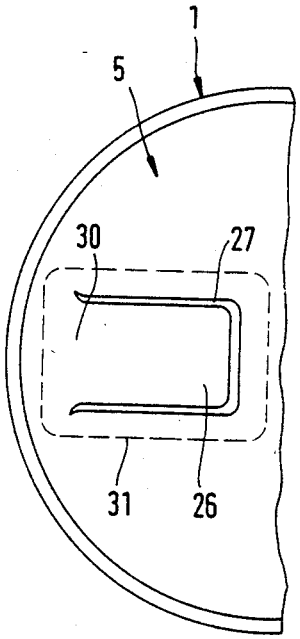
Figure 3:
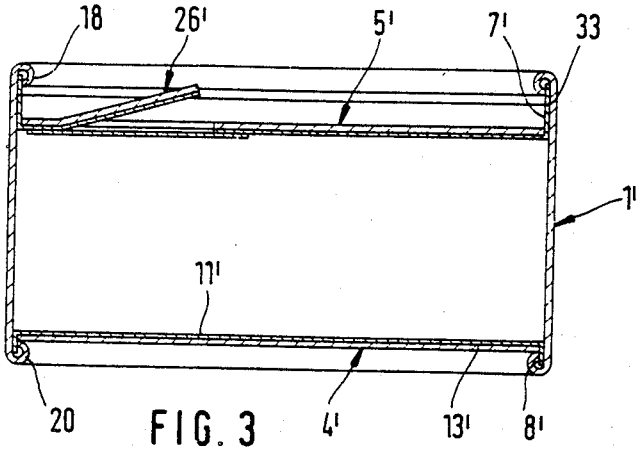

By deep-drawing, the aluminium foil 10,11 is provided with a cylindrical border 7,8 by which it is tightly connected by heat sealing or bonding to the inner surface of the container body 2. The outermost border 16,17 of the aluminium foil can also extend over the outer edge of the container body 2, as can be seen with the embodiments of FIG. 3, the outermost border 18 of container body 2 can also be beaded inwards and enclose part of the cylindrical border 7',8'. On the lower container base 4' in FIG. 3, the edge bead 20 formed by beading is led up to the cardboard plate 13', so that it forms a support for it. A similar construction is provided on box 1'' according to FIG. 2, in that the cardboard plate 13'' there is also supported by the lower edge bead 21, with the difference that the outermost border 22 of the aluminium foil 11'' surrounds said edge bead and is fixed between the cardboard plate 13'' and said edge bead 21.

A cardboard plate 13 reinforcing the container bases 4,5 can be made from corrugated cardboard 24 with a much greater thickness or also from several cardboard layers instead of from normal, compact cardboard material with a thickness of e.g. 0.8 mm and of at least 0.5 mm. As a result the cardboard takes up a significant part or the entire height of the cylindrical border 8 of the associated aluminium foil 11 and also can form a flush termination with the terminal edge 25 of the container body 2.

Despite the particularly robust, inventive construction of the container bases 4,5, the packing container 1,1' or 1'' can still be easily opened by hand without using a tool, by gripping the tear-open grip 26 between the thumb and index finger and drawing same upwards together with the container base 5 by a u-shaped punching line 27 and as is known per se for container bases made only from an aluminium foil from German Pat. No. 2 615 812. In a novel manner, the tear-open grip is punched in one operation both from the aluminium foil 10 and from the cardboard plate 12, so that it has an adequate resistance to tearing through the connection at its junction 30 with the container base 5.

According to the production process, the trimmed cardboard plate 12 is firmly joined to the aluminium foil 10 prior to the deep-drawing thereof, so that on deep-drawing, the tear-open grip 26 is precisely punched both from foil 10 and from the cardboard plate, i.e. without any necessary alignment. The opening in the container base resulting from the punching line 27 is subsequently tightly sealed by bonding or sealing an aluminium foil portion 31 on to the bottom or inside of the container base 5. This aluminium foil portion 31 also contributes to the resistance to tearing of the tear-open grip 26 or the container base in the vicinity of the junction 30 with the said grip 26.

Figure 4:
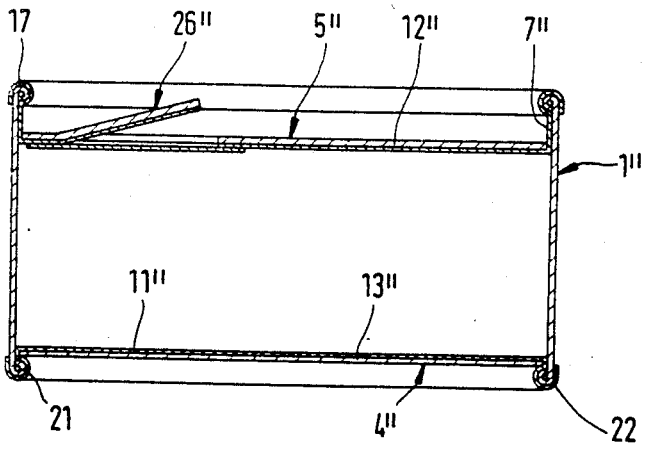

On removing the container base 5 from the container body 2 for the purpose of opening the packing container, the cylindrical border 7 of base 5 is drawn from the inner face of the container body, in that the bond or seal is destroyed there by the pealing or stripping off movement. If an embossed desired separating line 33 is to be provided in this cylindrical border 7 of the container base according to German Pat. No. 3 008 274 (FIG. 3), then detachment only takes place up to said desired separating line and the remainder of the border 7,7' or 7'' remains on the container body 2 and can permanently envelop the edge of the container body 2 in accordance with the embodiment of FIG. 4.

In the case of disposable containers, there is no need for reclosability, i.e. the further usability of the removed container base, but it is also possible to use the container base 5 as a container cover. For this purpose and in a not shown manner, the container body 2 can be provided with an all-round shoulder or individual shoulders, which act as a support for the container body.

When packing dry material, such as peanuts or the like, where contact with fingers is acceptable, there is also no need for a tear-open grip constructed as a tear-open tab 26, in that instead an opening corresponding to said tab is punched into the container base 5, which from the underside is then closed by a foil portion corresponding to aluminium foil portion 31. For opening the packing container, in this case the foil portion closing the opening is perforated with a finger, in order to engage below the container base with said finger and draw it upwards out of the container body. The stiff cardboard plate 12 thereby transfers the tension to the entire circumference of the container base to be removed. There is no need to close the punched opening, if the finger opening is only punched in the cardboard plate 12 before it is fixed to the aluminium foil 10. In such an embodiment, it is advantageous to protect the finger opening closed only by the thin aluminium foil 10 or the foil portion 31 by a not shown foil or cardboard portion stuck on to the outside of the container base 5, but which can easily be detached to give access to the finger opening.

What is claimed is:

1. A packing container having a cylindrical container body made from a coated cardboard material and container bases fixed to its two ends and which with a cylindrical border region are in contact with the inner face of the container body, at least one of the container bases comprising an aluminium foil and having a tear-open grip, wherein there is a cardboard plate fixed to the aluminium foil portion stretched over the open cross-section of the container body and thereby reinforcing said portion of a container base.

2. A packing container according to claim 1, wherein the cardboard plate has a thickness of at least 0.5 mm.

3. A packing container according to claim 1, wherein the cardboard plate or a layer thereof is made from corrugated cardboard.

4. A packing container according to claim 1, wherein the thickness of the cardboard plate is at least equal to half the height of the cylindrical border region of the container base.

5. A packing container according to claim 1, wherein the thickness of the cardboard plate is equal to the distance between the aluminium foil portion stretched over the open cross-section of the container body and the outer edge of the container body.

6. A packing container according to claim 1, wherein a tear-open grip is provided on that part of the container base stretching over the open cross-section of the container body, said grip being located between the cylindrical border region and the centre of the container base.

7. A packing container according to claim 1, wherein a tear-open grip is constructed as a tab and is shaped from the container base trough a punching line extending through the cardboard plate and the aluminium foil of the container base, the opening formed by the punching line being closed by a foil portion, which is tightly fixed to the container base side facing the interior of the packing container.

8. A packing container according to claim 1, wherein the tear-open grip is formed by a finger opening provided in the cardboard plate of one of the container bases and which is closed by the aluminium foil and/or a foil potion.

9. A packing container according to claim 1, wherein the side of the aluminium foil sealing the container body remote from the the interior of the container is coated with a plastic material and the connection along the overlap seam is made by a normal overlap and by an adhesive.

* * * * *